US007726478B2

(12) United States Patent
Potterfield et al.

(10) Patent No.: US 7,726,478 B2
(45) Date of Patent: Jun. 1, 2010

(54) CONTAINERS FOR CARRYING FIREARM ACCESSORIES AND/OR SUPPORTING FIREARMS

(75) Inventors: Russell A. Potterfield, Columbia, MO (US); Tim Morrow, Jefferson City, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 672 days.

(21) Appl. No.: 11/679,172

(22) Filed: Feb. 26, 2007

(65) Prior Publication Data

US 2007/0294929 A1 Dec. 27, 2007

Related U.S. Application Data

(60) Provisional application No. 60/777,466, filed on Feb. 27, 2006, provisional application No. 60/798,653, filed on May 8, 2006.

(51) Int. Cl.
*B65D 85/00* (2006.01)

(52) U.S. Cl. ..... 206/317

(58) Field of Classification Search ..... 206/315.1, 206/317; 312/244, 285
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |

(Continued)

FOREIGN PATENT DOCUMENTS

| | | |
|---|---|---|
| DE | 838872 | 5/1952 |

(Continued)

OTHER PUBLICATIONS

Final Office Action; U.S. Appl. No. 11/206,430; Mailed on Nov. 24, 2008, 28 pages.

(Continued)

*Primary Examiner*—Jacob K Ackun Jr.
(74) *Attorney, Agent, or Firm*—Perkins Coie LLP

(57) ABSTRACT

Containers for carrying firearm accessories (e.g., cleaning and maintenance supplies and tools) and/or supporting firearms are disclosed herein. In one embodiment, a container includes a housing having an exterior side surface, an aperture in the exterior side surface, a storage device at the aperture, and a support structure at the housing. The storage device has a compartment and is movable between (a) a stowed position in which the compartment is positioned within the housing, and (b) a second position in which the compartment is at least partially external to the housing. The support structure is configured to interface with a removable firearm support for carrying a firearm.

52 Claims, 6 Drawing Sheets

U.S. PATENT DOCUMENTS

| | | | |
|---|---|---|---|
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,488,647 | A | 4/1924 | Quinn |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,638,676 | A | 5/1953 | Callahan |
| 2,677,207 | A | 5/1954 | Stewart |
| 2,701,930 | A | 2/1955 | Dolan |
| 2,731,829 | A | 1/1956 | Wigington et al. |
| 2,740,530 | A | 4/1956 | Ponder |
| 2,753,642 | A | 7/1956 | Sullivan |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,112,567 | A | 12/1963 | Flanagan |
| 3,125,929 | A | 3/1964 | Peasley |
| 3,128,668 | A | 4/1964 | Dicken |
| 3,163,420 | A | 12/1964 | Braun |
| 3,175,456 | A | 3/1965 | Goodsell |
| 3,183,617 | A | 5/1965 | Ruger et al. |
| 3,206,885 | A | 9/1965 | Dye |
| 3,225,656 | A | 12/1965 | Flaherty et al. |
| D203,680 | S | 2/1966 | Benchrest |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,739,515 | A | 6/1973 | Koon, Jr. |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,877,178 | A | 4/1975 | Campanelli |
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |
| D237,106 | S | 10/1975 | Baljet et al. |
| 3,913,746 | A | 10/1975 | Burton |
| 3,914,879 | A | 10/1975 | Taylor, III et al. |
| 3,935,657 | A | 2/1976 | Wade |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,021,971 | A | 5/1977 | McFadden |
| 4,026,057 | A | 5/1977 | Cady |
| 4,027,781 | A | 6/1977 | Covert |
| 4,042,242 | A | 8/1977 | Nicholls et al. |
| 4,054,288 | A | 10/1977 | Perrine, Sr. |
| 4,055,016 | A | 10/1977 | Katsenes |
| 4,072,313 | A | 2/1978 | Murso et al. |
| 4,076,247 | A | 2/1978 | Kim et al. |
| 4,120,108 | A | 10/1978 | Vickers et al. |
| 4,120,276 | A | 10/1978 | Curran |

4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,721,205 A * 1/1988 Burt et al. ..... 206/317
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,149,900 A 9/1992 Buck
5,173,563 A 12/1992 Gray
5,180,874 A 1/1993 Troncoso, Jr
5,185,927 A 2/1993 Rivers
5,186,468 A 2/1993 Davies
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A 7/1994 Walker, III
5,333,829 A 8/1994 Bell et al.
5,335,578 A 8/1994 Lorden et al.
5,344,012 A 9/1994 Matthews
5,347,740 A 9/1994 Rather et al.
5,351,428 A 10/1994 Graham
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler 5,375,377 A 12/1994 Kenton
5,377,437 A 1/1995 Underwood
5,392,553 A 2/1995 Carey
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,758,933 A * 6/1998 Clendening ..... 312/205
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,857,279 A 1/1999 de Oliveira et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,044,747 A 4/2000 Felts
6,058,641 A 5/2000 Vecqueray
6,073,381 A 6/2000 Farrar et al.
6,086,375 A 7/2000 Legros
6,110,020 A 8/2000 Rolfi
6,121,556 A 9/2000 Cole
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 * 1/2007 Gardner ..... 206/317
D540,904 S 4/2007 Werner
7,207,567 B1 4/2007 Brown
7,225,050 B2 5/2007 Sutula, Jr.
D553,219 S 10/2007 Potterfield
7,281,346 B1 * 10/2007 Cook et al. ..... 42/94
D567,895 S 4/2008 Cauley
7,357,250 B2 4/2008 Hagemann et al.
7,363,740 B2 4/2008 Kincel
7,401,431 B2 7/2008 Pierce et al.
D576,245 S 9/2008 Potterfield et al.
7,426,800 B2 9/2008 Pierce et al.
2002/0113372 A1 8/2002 Love
2004/0020097 A1 2/2004 Deros
2004/0134113 A1 7/2004 Deros et al.
2005/0000141 A1 1/2005 Cauley et al.
2005/0011101 A1 1/2005 Gooder
2005/0115137 A1 6/2005 Minneman

| | | | |
|---|---|---|---|
| 2005/0183319 | A1 | 8/2005 | Franks |
| 2005/0188597 | A1 | 9/2005 | Keng et al. |
| 2005/0242250 | A1 | 11/2005 | Keng et al. |
| 2006/0174532 | A1 | 8/2006 | Popikow |
| 2006/0175213 | A1 | 8/2006 | Hurt et al. |
| 2006/0218840 | A1 | 10/2006 | Cauley |
| 2006/0248774 | A1 | 11/2006 | Pierce et al. |
| 2006/0248775 | A1 | 11/2006 | Wade et al. |
| 2006/0254111 | A1 | 11/2006 | Giauque et al. |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0068379 | A1 | 3/2007 | Sween et al. |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0295197 | A1 | 12/2007 | Potterfield |
| 2008/0023379 | A1 | 1/2008 | Potterfield et al. |
| 2008/0023915 | A1 | 1/2008 | Morrow et al. |
| 2008/0034636 | A1 | 2/2008 | Potterfield et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0168697 | A1 | 7/2008 | Potterfield et al. |
| 2008/0174071 | A1 | 7/2008 | Potterfield et al. |
| 2009/0049731 | A1 | 2/2009 | Seuk |
| 2009/0056192 | A1 | 3/2009 | Oz |
| 2009/0126250 | A1 | 5/2009 | Keng |

FOREIGN PATENT DOCUMENTS

| | | |
|---|---|---|
| EP | 0624455 | 11/1994 |
| GB | 475080 | 11/1937 |

OTHER PUBLICATIONS

Final Office Action; U.S. Appl. No. 11/339,863; Mailed on Mar. 10, 2009, 22 pages.
Final Office Action; U.S. Appl. No. 11/505,784; Mailed on Dec. 19, 2008, 10 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/607,550; Mailed on Mar. 2, 2009, 11 pages.
Non-Final Office Action; U.S. Appl. No. 11/801,341; Mailed on Jan. 13, 2009, 7 pages.
Non-Final Office Action; U.S. Appl. No. 11/853,763; Mailed on Dec. 22, 2008, 6 pages.
U.S. Appl. No. 11/431,956, filed May 10, 2006, Morrow et al.
U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed July 14, 2008, Cesternino et al.
U.S. Appl. No. 12/177,032, filed July 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo WII, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
1shop2.com "Hoppe's Gunsmith's Fully Adjustable Bench Vise," http://www.1shop2.com/outdoor_sports/Hoppe's—Gunsmith's-Fully-Adj..., 3 pgs, the date on which The Hoppe's Gunsmith's Fully Adjustable Bench vise was first on sale is not known, but is believed to be circa 2004.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Californiavarmintcallers.com—Forum, http://californiavarmintcallers.com/community/modules/newbb/viewtopic.php?topic_id=10&forum=9&PHPSESSID=074ed8c7..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2pgs. [Internet accessed Jan. 16, 2006].

Lee Precision, Inc., "The World's Fastest Handloading Press. . . Lee Progressive 1000," 1985 Catalog, pp. 1-15.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
Sweeney, P "gunsmithing: Measure Headspace," Peterson's Rifleshooter, http://www.rifleshootermag.com/gunsmithing/headspace_0612/, 4pages [Internet accessed Dec. 11, 2004].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006 ].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B, pp. 76-78.
Device manufactured by Shooter's Ridge, a division of ATK, and available at least by late 2005, 1 page.
"Uncle Bud's Udder Bag," http:www.unclebudscss.com/pages/Udder%20Bags.html, 2 pp. [Internet accessed on Feb. 14, 2006 ].
"Uncle Bud's Bull Bags," http:www.unclebudscss.com/pages/Bulls%20bags.html, 2 pp. [Internet accessed on Feb. 14, 2006 ].
Protektor Model, "The Original Leather Rifle and Pistol Rest," http://www.protektormodel.com/, 12 pages [ Internet accessed on Feb. 14, 2006 ].
Edgewood Shooting Bags Catalog, http://www.edgebag.com/catalog.php, 7 pages [Internet accessed on Feb. 14, 2006 ].
Canadian Camo, "Gun Rest," http://media5.magma.ca/www.canadiancamo.com/catalog/product_info.php?products_id=..., 2 pages [Internet accessed on Feb. 13, 2006 ].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabelas/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type= product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitem id=729197&t=11082005, 2005, 3 pages [Internet accessed on Aug. 6, 2008].
MidwayUSA, "Shooting Supplies —Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].

Amazon.com, "CTK®P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www..joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup_2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5- _7gnY4CFRVNhgodjFhfSQ, 29 pages [Internet accessed on Aug. 30, 2007].
International Search Report and Written Opinion; International Patent Application No. PCT/US07/76587; Filed: Aug. 22, 2007; Applicant: Battenfeld Technologies, Inc.; Mailed on Jul 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 07, 2006, 8 pages.
Final Office Action; U.S. Appl. No. 10/865,595; Mailed on Apr. 03, 2007, 10 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
U.S. Appl. No. 12/476,041, filed Jun. 1, 2008, Cauley.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/853,763; Mailed on Jul. 13, 2009, 7 pages.
Non-Final Office Action; U.S. Appl. No. 11/679,169; Mailed on Apr. 28, 2009, 11 pages.
Non-Final Office Action; U.S. Appl. No. 11/853,745; Mailed on Jun. 19, 2009, 11 pages.
Non-Final Office Action; U.S. Appl. No. 12/117,668; Mailed on Aug. 13, 2009, 15 pages.
Non-Final Office Action; U.S. Appl. No. 11/679,832; Mailed on Aug. 28, 2009, 9 pages.
U.S. Appl. No. 12/578,393, filed Oct. 13, 2009, Morrow et al.
Final Office Action; U.S. Appl. No. 11/801,341; Mailed on Sep. 30, 2009, 6 pages.
Non-Final Office Action; U.S. Appl. No. 11/739,077; Mailed on Oct. 8, 2009, 7 pages.
Non-Final Office Action; U.S. Appl. No. 12/209,113; Mailed on Sep. 23, 2009, 6 pages.
Non-Final Office Action; U.S. Appl. No. 11/206,430; Mailed on Jun. 23, 2009, 13 pages.
Non-Final Office Action; U.S. Appl. No. 11/505,784; Mailed on Oct. 27, 2009, 8 pages.
U.S. Appl. No. 12/209,113, filed Sep. 11, 2008, Potterfield et al.
U.S. Appl. No. 12/276,223, filed Nov. 21, 2008, Potterfield et al.
U.S. Appl. No. 12/276,229, filed Nov. 21, 2008, Cauley et al.
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
"Cabela's Rotary Media Separator," http://www.cabelas/en/templates/links/link.jsp;jsessionid=QYVQMKM0P0P5.., 2 pages [Internet accessed Apr. 24, 2007].
RCBS, "Reloading Equipment," http://www.rcbs.com/default.asp?menu=1&s1=4&s2=3&s3=25, 1 page [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 13 pages.
International Search Report and Written Opinion; International Patent Application No. PCT/US07/76440; Filed: Aug. 21, 2007; Applicant: Battenfeld Technologies, Inc.; Mailed on Sep. 30, 2008.
Non-Final Office Action; U.S. Appl. No. 11/339,863; Mailed on Sep. 23, 2008, 7 pages.
Final Office Action; U.S. Appl. No. 11/271,100; Mailed on Sep. 22, 2008, 8 pages.
Non-Final Office Action; U.S. Appl. No. 11/507,683; Mailed on Sep. 18, 2008, 8 pages.
Non-Final Office Action; U.S. Appl. No. 11/679,100; Mailed on Oct. 16, 2008, 11 pages.

* cited by examiner

CONTAINERS FOR CARRYING FIREARM ACCESSORIES AND/OR SUPPORTING FIREARMS

CROSS-REFERENCE TO RELATED APPLICATIONS

This application claims the benefit of U.S. Provisional Patent Application No. 60/777,466, filed Feb. 27, 2006, and U.S. Provisional Patent Application No. 60/798,653, filed May 8, 2006, both of which are incorporated by reference herein.

TECHNICAL FIELD

The present disclosure is directed to containers for carrying firearm accessories and/or supporting firearms.

BACKGROUND

Rifles, shotguns, and other firearms should be periodically cleaned and maintained to ensure accuracy and proper operation. Firearms may be supported for cleaning and maintenance by shop vises or other firearm supports that are typically mounted to a table or bench. These devices, however, are not well suited for use while hunting, engaging in target practice, or traveling. To address this problem, several conventional containers for carrying firearm cleaning supplies have been adapted to also support a firearm. For example, one conventional container includes a rigid plastic housing, a lid connected to the housing with hinges, and two forks removably attached to the housing for supporting a firearm. The housing has an opening at the top and an interior cavity with receptacles sized to each receive a fork.

One drawback of conventional containers for carrying firearm cleaning supplies is that it is difficult to retrieve supplies from the housing when a firearm is placed on the forks. For example, in some containers supplies are stored under the forks and the forks must be removed to access the supplies. Moreover, the position of the firearm close to the opening of the housing also inhibits access to supplies in the cavity. Another drawback of conventional containers is that the containers are bulky devices, long and high. As a result, the containers are expensive to ship because shipping rates are based in part on the volume of the package. In addition, because the containers are made of a rigid plastic material, the containers often crack during transit. Accordingly, there exists a need to improve conventional containers for carrying firearm cleaning supplies.

DETAILED DESCRIPTION

A. Overview

Figure 1:
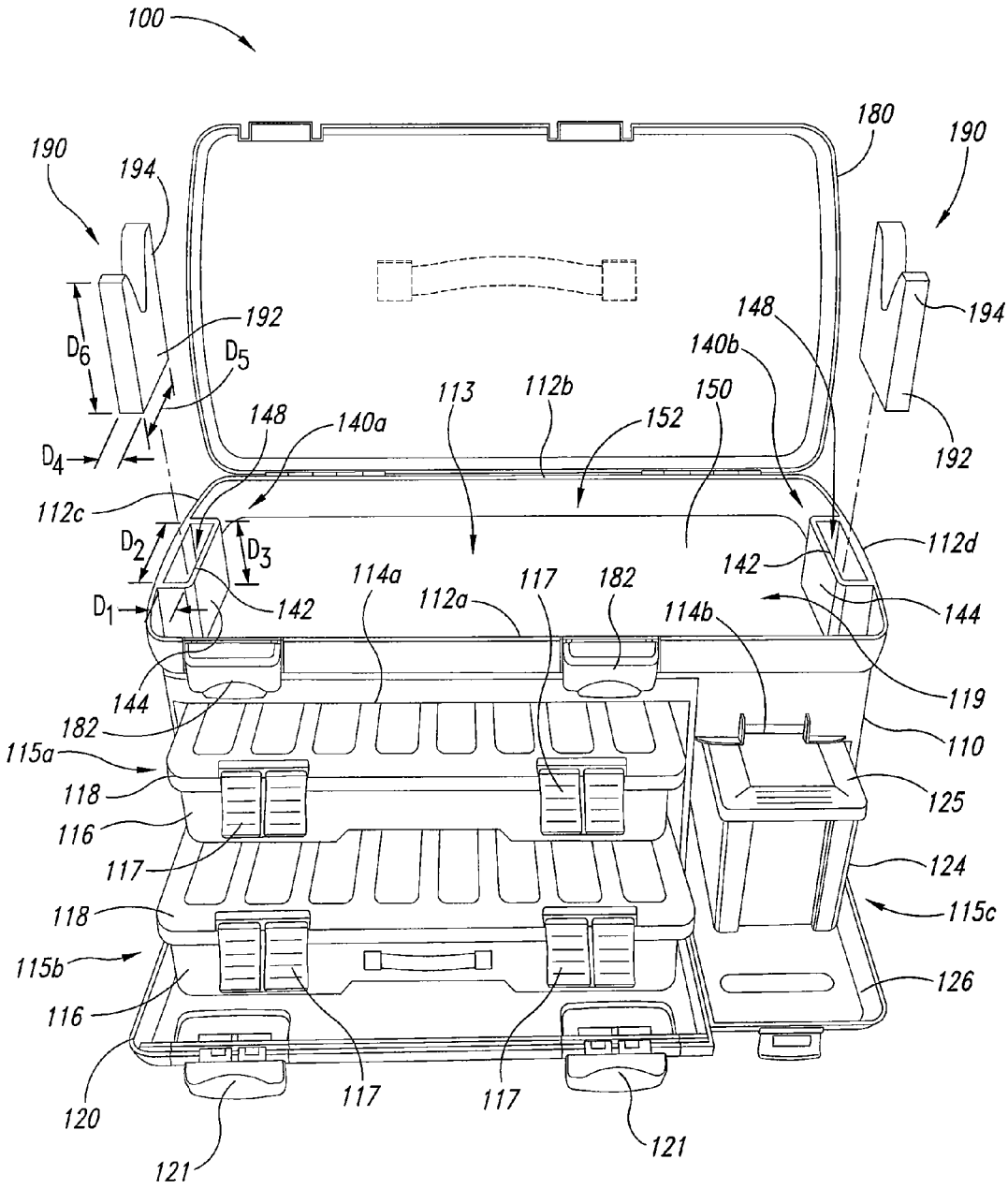
FIG. 1 is a front isometric view of a container for carrying firearm accessories and supporting a firearm in accordance with one embodiment of the disclosure.

The following disclosure describes several embodiments of containers for carrying firearm accessories (e.g., cleaning and maintenance supplies and tools) and/or supporting firearms. One aspect of the invention is directed to containers for carrying firearm accessories. In one embodiment, a container includes a housing having an exterior side surface, an aperture in the exterior side surface, a storage device at the aperture, and a support structure at the housing. The storage device has a compartment and is movable between (a) a stowed position in which the compartment is positioned within the housing, and (b) a second position in which the compartment is at least partially external to the housing. The support structure is configured to interface with a removable firearm support for carrying a firearm.

In another embodiment, a container includes a housing having a plurality of sides, a plurality of compartments within the housing, and a support structure at the housing. At least one of the sides includes a flexible material. The compartments are sized to receive firearm accessories, and the support structure is configured to interface with a removable firearm support. The support structure is positioned such that the firearm support projects from the housing when the firearm support interfaces with the support structure.

Another aspect of the invention is directed to receptacles for supporting firearms. In one embodiment, a receptacle includes an enclosure having a plurality of sides and an opening defined by at least one of the sides. The receptacle further includes a lid operably coupled to the enclosure, an aperture in one of the sides, a tray externally accessible via the aperture, and a support structure at the enclosure. The lid is positioned at the opening. The tray has a plurality of compartments sized to receive firearm accessories. The support structure is configured to support a removable firearm support for carrying a firearm. The support structure is positioned such that the firearm support projects through the opening when the support structure supports the firearm support.

In another embodiment, a receptacle includes (a) an enclosure having a plurality of sides and an aperture, (b) a storage device within the enclosure and positioned at the aperture, (c) a support structure at the enclosure, and (d) a firearm support removably coupled to the support structure. At least one of the sides includes a flexible portion. The storage device has a compartment sized to receive a firearm accessory, and the firearm support is configured to carry a section of the firearm.

In another embodiment, a receptacle includes a housing having a side surface, an aperture in the side surface, means for storing firearm accessories in the housing such that the firearm accessories can be removed from the housing via the aperture, and means for supporting a removable firearm support configured to carry a firearm.

Another aspect of the invention is directed to methods of supporting a firearm for cleaning and/or maintenance. In one embodiment, a method includes removably attaching first and second firearm supports to corresponding support structures at an opening of a container, placing the firearm on the first and second firearm supports, and moving a storage device at least partially through an aperture in a side of the container.

Specific details of several embodiments of the invention are described below with reference to containers for carrying firearm accessories and/or supporting firearms. Several details describing well-known structures or processes often associated with containers, firearms, and firearm supports are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-4.

Where the context permits, singular or plural terms may also include the plural or singular terms, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Containers for Carrying Firearm Accessories and/or Supporting Firearms

FIG. 1 is a front isometric view of a container 100 for carrying firearm accessories and supporting a firearm in accordance with one embodiment of the disclosure. The illustrated container 100 includes an enclosure or housing 110 and two firearm supports 190 removably coupled to the housing 110. The housing 110 has a plurality of sides 112 (identified individually as 112*a-d*), a bottom (not shown), and an opening 119 at the top. The sides 112 and bottom define an internal cavity 113 in which firearm accessories and/or the firearm supports 190 can be stored. The illustrated first side 112*a* includes a plurality of apertures 114 (identified individually as 114*a-b*) that provide access to the internal cavity 113 from outside the housing 110. In the illustrated embodiment, the housing 110 is composed of a generally non-flexible (i.e., rigid) material such as a hard plastic or metal. In other embodiments, such as the embodiments described below with reference to FIGS. 3 and 4, the entire housing or portions of the housing can be composed of a flexible material.

The container 100 further includes a plurality of storage devices 115 (identified individually as 115*a-c*) for holding firearm components and/or accessories. The illustrated first and second storage devices 115*a-b* include a tray 116 and a lid 118 removably attached to the tray 116. Each tray 116 can include a plurality of compartments of one or more sizes for receiving and storing firearm components and/or accessories. In other embodiments, the storage devices 115, or other storage devices described below, can be configured to accept multiple trays or dividers such that the storage devices 115 can have adjustable storage. The lids 118 retain the components and accessories in the trays 116 and protect the components and accessories when the trays 116 are removed. One end of the lids 118 may be pivotably coupled to the trays 116 with a hinge, and the other end of the lids 118 can be removably attached to the trays 116 with one or more latches 117. The illustrated first and second storage devices 115*a-b* are positioned at the first aperture 114*a* in the housing 110 and are slidable between (a) a stowed position in which the first and second storage devices 115*a-b* are received within the cavity 113, and (b) a second position in which the first and second storage devices 115*a-b* are at least partially external to the housing 110. As such, the compartments in the trays 116 are accessible to a user when the storage devices 115*a-b* are in the second position. In certain embodiments, the storage devices 115, as well as other storage devices described below, can also include a handle 111 to facilitate removing and carrying the storages devices separately from the container 100. In addition, the container 100 and/or storage devices can be configured to be secured in a locked or closed position to prevent unauthorized access to the container 100. For example, the container 100 may be locked with a padlock or similar device, thereby restricting access to the contents of the container 100 and storage devices.

The third storage device 115*c* includes a box 124 and a lid 125 releasably attached to the box 124. The box 124 may include a single compartment or multiple compartments for storing firearm components and/or accessories. The third storage device 115*c* is positioned at the second aperture 114*b* and slidable between (a) a stowed position in which the device 115*c* is received within the cavity 113, and (b) a second position in which at least a portion of the device 115*c* is external to the housing 110 and accessible to the user. In additional embodiments, the container 100 may include one or more storage devices in a different arrangement. In either case, at least one storage device 115 is accessible via an aperture 114 in a sidewall 112 of the housing 110. As a result, the storage devices 115 can be easily accessed whether or not the container 100 is supporting a firearm.

The illustrated container 100 also includes first and second covers 120 and 126 pivotably attached to the housing 110. The covers 120 and 126 pivot between an open position (shown in FIG. 1) and a closed position (not shown). In the open position, the user can access and remove the storage devices 115 from the housing 110. In the closed position, the covers 120 and 126 retain the storage devices 115 within the cavity 113. The covers 120 and 126 may include one or more latches 121 to keep the covers 120 and 126 from inadvertently opening. In other embodiments, the container 100 may not include the covers 120 and 126.

The container 100 in the illustrated embodiment further includes a generally horizontal partition 150, an upper compartment 152 defined by the partition 150 and the sides 112 of the housing 110, and a lid 180 pivotably coupled to the housing 110. The lid 180 includes a handle 181 (shown in broken lines) attached to the lid 180 for carrying the container. The compartment 152 can be sized to receive and carry the firearm supports 190 when the firearm supports 190 are detached from the housing 110. The lid 180 is pivotable between an open position (shown in FIG. 1) and a closed position (not shown). In the open position, a user can access the compartment 152. In the closed position, the lid 180 covers the opening 119 and contacts the sides 112 to retain items in the compartment 152. The housing 110 may also include a plurality of latches 182 to selectively lock the lid 180 in the closed position. In other embodiments, the lid 180 may be removably coupled to the housing 110, or the container 100 may not include a lid.

The container 100 further includes a plurality of support structures 140 (identified individually as 140*a-b*) for supporting corresponding firearm supports 190. In the illustrated embodiment, the individual support structures 140 include a receptacle 142 configured to receive a portion of the corresponding firearm supports 190. Specifically, the receptacle 142 includes a wall 144 and a hole 148 defined by the wall 144. The hole 148 has a first dimension $D_1$ corresponding to a thickness $D_4$ of the firearm supports 190, and a second dimension $D_2$ corresponding to a width $D_5$ of the firearm supports 190. Although the illustrated support structures 140 include receptacles 142 for receiving a portion of the firearm supports 190, in other embodiments the support structures 140 may have a different configuration. For example, the support structures may include a post or other projection that is received by a receptacle on the firearm support. In either case, the illustrated first support structure 140*a* is positioned proximate to the third side 112*c* of the housing 110, and the illustrated second support structure 140*b* is positioned proximate to the fourth side 112*d* of the housing 110. As a result, the distance between the support structures 140 spaces apart the firearm supports 190 such that one firearm support 190 can carry a forward section of the firearm and the other firearm support 190 can carry a rearward section of the firearm. In other embodiments, however, the container 100 may include a single firearm support 190 and a single support structure 140.

The illustrated firearm supports 190 are configured to be removably attached to corresponding support structures 140. Specifically, the individual firearm supports 190 include a first portion 192 sized to be positioned in the hole 148 and a second portion 194 configured to contact the firearm. In the illustrated embodiment, the second portion 194 has a generally V-shaped configuration to inhibit side-to-side movement of the firearm and support the firearm in an upright position. In other embodiments, the second portion 194 may include a clamping mechanism for retaining the firearm in the firearm support 190. The second portion 194 may also include a non-marring material to prevent damage to the firearm. In other embodiments, the firearm supports 190 can have a different configuration. In either case, the individual firearm supports 190 have a height $D_6$ greater than a depth $D_3$ of the receptacle 142. As a result, the firearm supports 190 project from the housing 110 to support the firearm away from the housing 110. As a result, in several embodiments a user can access the upper compartment 152 while the firearm supports 190 carry the firearm. In additional embodiments, the firearm supports 190 and/or the support structures 140 can include a detent or other mechanism for releasably locking the firearm supports 190 to the support structures 140 to prevent inadvertent detachment.

Figure 2:
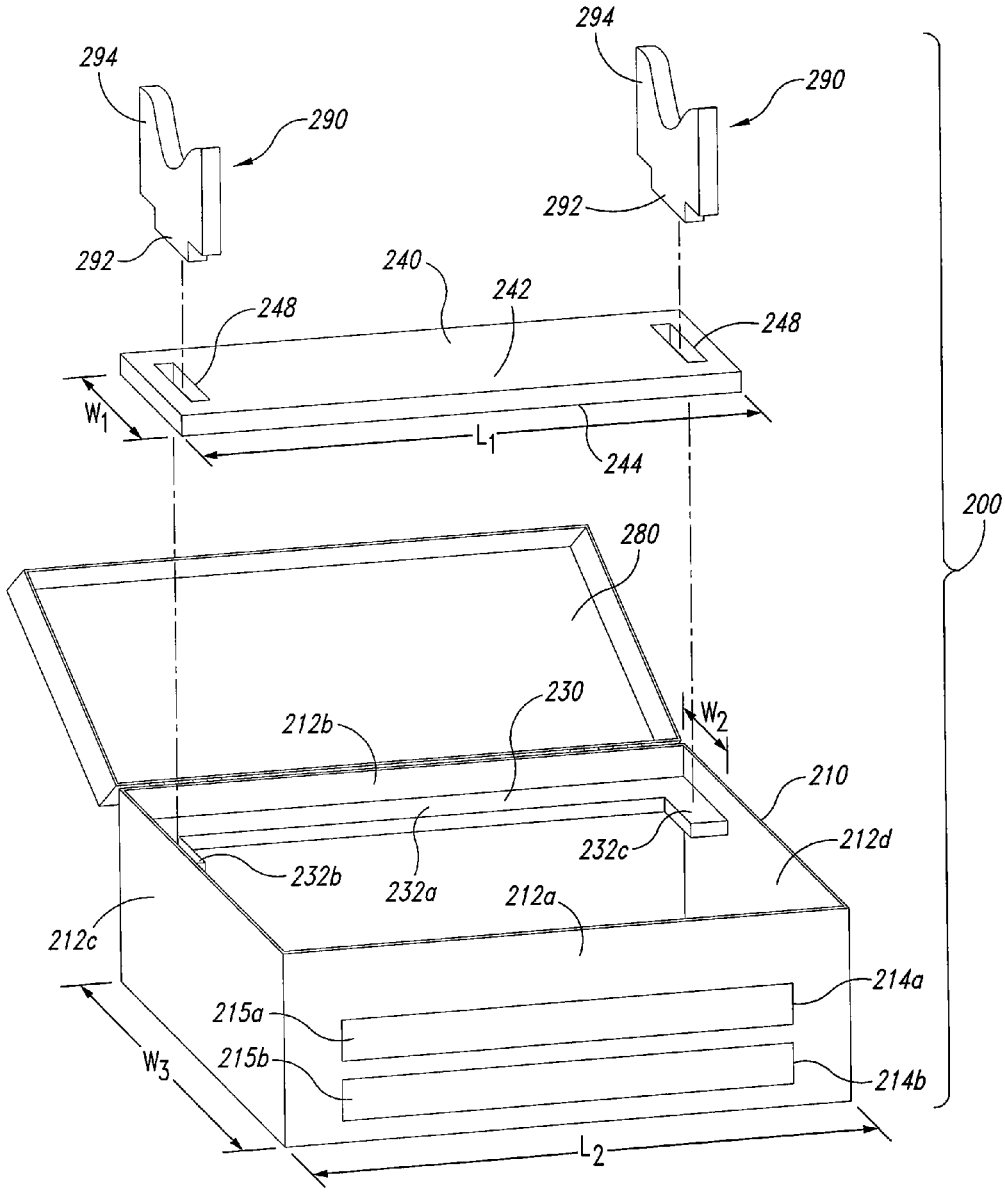
FIG. 2 is a schematic isometric view of a container for carrying firearm accessories and supporting a firearm in accordance with another embodiment of the disclosure.

C. Additional Embodiments of Containers for Carrying Firearm Accessories and/or Supporting Firearms FIG. 2 is a schematic isometric view of a container 200 for carrying firearm accessories and supporting a firearm in accordance with another embodiment of the invention. The container 200 is generally similar to the container 100 described above with reference to FIG. 1. For example, the container 200 includes (a) a housing 210 with a plurality of sides 212 (identified individually as 212*a-d*) and a plurality of apertures 214 (identified individually as 214*a-b*) in the first side 212*a*, (b) a plurality of storage devices 215 (identified individually as 215*a-b*) positioned at corresponding apertures 214, and (c) a support structure 240 removably received in the housing 210 for supporting removable firearm supports 290. The storage devices 215 can be trays, boxes, bags, or other suitable members for carrying and storing firearm accessories and/or components. In the illustrated embodiment, however, the housing 210 includes a support shelf 230 upon which the support structure 240 can rest. The support shelf 230 can include a first section 232*a* projecting generally inwardly from the second side 212*b*, a second section 232*b* projecting generally inwardly from the third side 212*c*, and a third section 232*c* projecting generally inwardly from the fourth side 212*d*. The illustrated second and third sections 232*b-c* do not extend along the entire third and fourth sides 212*c-d*, respectively, but rather have a width $W_2$.

The support structure 240 includes a first side 242, a second side 244 opposite the first side 242, and a plurality of apertures 248 extending between the first and second sides 242 and 244. The first and/or second sides 242 and/or 244 can be generally planar or include one or more compartments (e.g., recesses) for storing supplies or tools. The support member 240 has a length $L_1$ corresponding to a length $L_2$ of the housing 210 and a width $W_1$ corresponding to the width $W_2$ of the second and third sections 232*b-c*. As such, the support structure 240 can be placed on the support shelf 230 while still leaving room between the support structure 240 and the first side 212*a* for a user to access items stored within the housing 210. In other embodiments, the support structure 240 may extend between the first and second sides 212*a-b* as well as between the third and fourth sides 212*c-d*. In either case, the illustrated apertures 248 are sized to receive a first portion 292 of the firearm supports 290 such that the firearm supports 290 can be spaced apart from each other and project from the housing 210 to support a firearm. In other embodiments, however, the support shelf 230 may have a different configuration. For example, the second and third sections 232*b-c* may have a lip, detent, or other member to inhibit the support structure 240 from sliding away from the second side 212*b* and toward the first side 212*a*.

Figure 3:
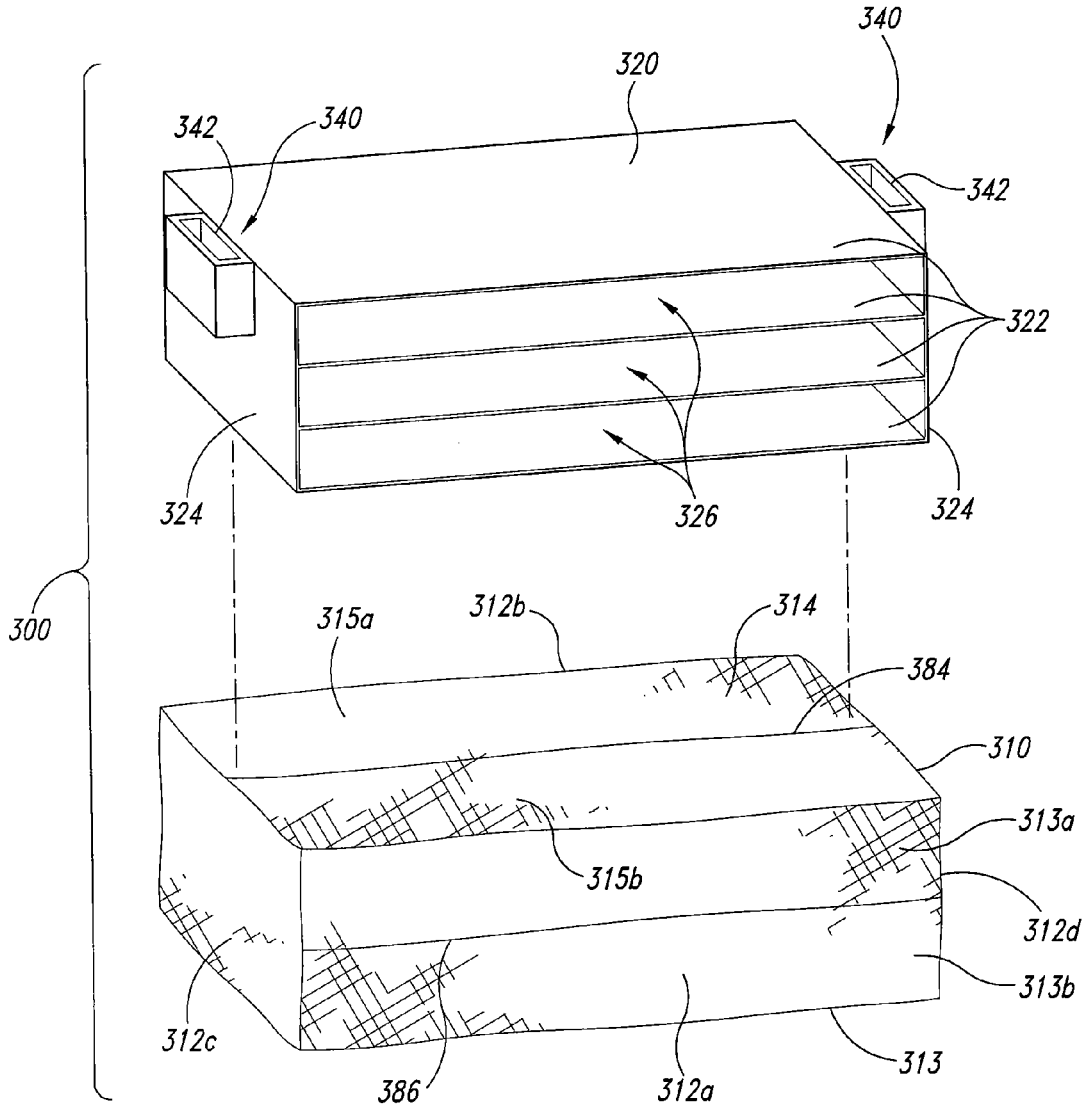
FIG. 3 is a schematic isometric view of a container for carrying firearm accessories and supporting a firearm in accordance with another embodiment of the disclosure.

FIG. 3 is a schematic isometric view of a container 300 in accordance with another embodiment of the disclosure. The illustrated container 300 includes a housing 310 and a frame 320 removably received in the housing 310. In the illustrated embodiment, the housing 310 is composed entirely of a flexible material (e.g., nylon, polypropylene, or fabric); however, in other embodiments the housing 310 may include non-flexible material. In either case, the housing 310 includes a plurality of side surfaces 312 (identified individually as 312*a-d*), a bottom surface 313, and a top surface 314 opposite the bottom surface 313. The illustrated first side surface 312*a* has a first portion 313*a* adjacent to the top surface 314, a second portion 313*b* adjacent to the bottom surface 313, and an aperture 386 extending between the first and second portions 313*a-b*. Because the first side surface 312*a* is made of a flexible material, the first and second portions 313*a-b* can be pulled apart so that a user can access the interior of the housing 310 via the opening 386. In several embodiments, the housing 310 may further include a connector for releasably connecting the first and second portions 313*a-b*. Suitable connectors include zippers, buttons, or other fasteners. The illustrated top surface 314 includes a first portion 315*a* adjacent to the second side surface 312*b*, a second portion 315*b* adjacent to the first side surface 312*a*, and an opening 384 extending between the first and second portions 315*a-b*. Because the top surface 314 is comprised of a flexible material, the first and second portions 315*a-b* can be pulled apart so that a user can access the interior of the housing 310 via the opening 384. The top surface 314 may further include a connector for releasably connecting the first and second portions 315*a-b* to close the opening 384. The housing 310 may also include a strap or handle (not shown) configured to facilitate carrying the container 300.

The frame 320 of the illustrated embodiment includes a plurality of horizontal panels 322 and a plurality of side panels 324 coupled to the horizontal panels 322. The horizontal and side panels 322 and 324 define a plurality of chambers 326 sized to receive storage devices such as trays, boxes, or bags. In other embodiments, the chambers 326 comprise a sub-frame configured to receive storage devices, such that the chambers 326 are defined by portions of the panels 322 and 324 rather than by the full panels 322 and 324. When the frame 320 is received in the housing 310, the chambers 326 are positioned at the opening 386 so that a user can access the storage devices via the opening 386. The illustrated frame 320 further includes a plurality of support structures 340 attached to the side panels 324. In some embodiments, the support structures 340 are not attached to the side panels 324 or integral with the frame 320. The individual support structures 340 can include a receptacle 342 sized to receive a portion of a firearm support. When the frame 320 is received in the housing 310, the support structures 340 are positioned at the opening 384 such that a user can place the firearm supports in the receptacles 342 via the opening 384. In other embodiments, the housing 310 and/or the frame 320 can have a different configuration. For example, the housing 310 may not include the opening 386, and/or the frame 320 can be configured such that the panels 322 are vertically oriented to create vertical chambers so that the storage devices can be accessed via the opening 384. Alternatively, the support structures 340 may be positioned in the first portion 313*a* and are supported by an additional support member (not shown) and the frame 320 is positioned in the second portion 313*b*.

Figure 4:
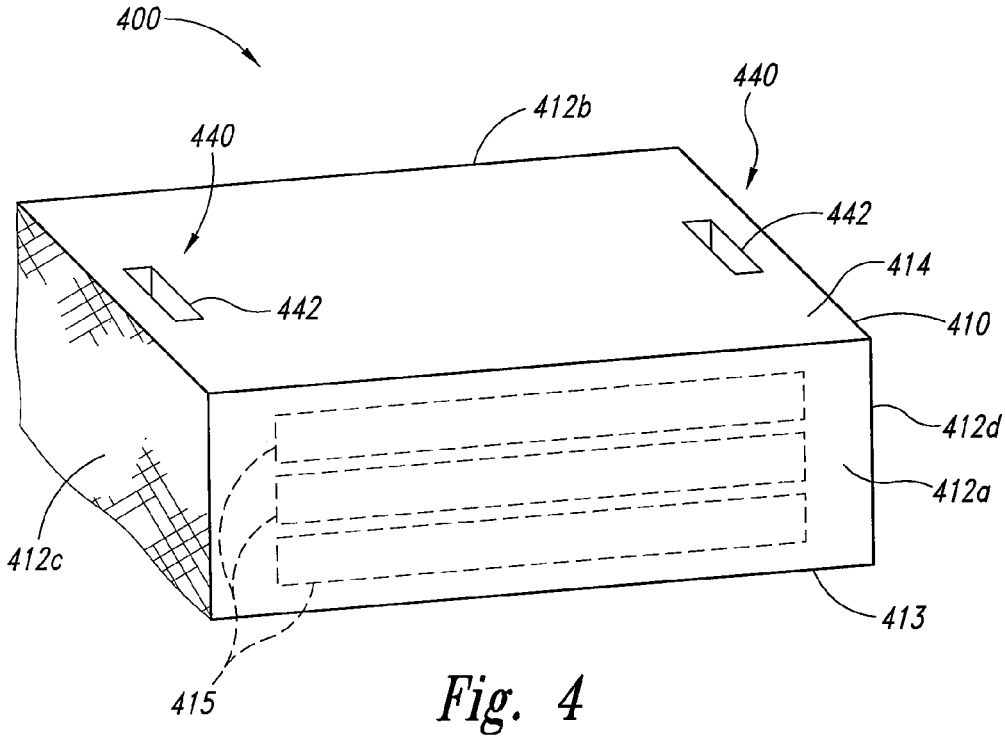
FIG. 4 is a schematic isometric view of a container for carrying firearm accessories and supporting a firearm in accordance with another embodiment of the disclosure.

FIG. 4 is a schematic isometric view of a container 400 in accordance with another embodiment of the disclosure. The illustrated container 400 is generally similar to the container 100 described above with reference to FIG. 1. For example, the container 400 includes a housing 410 having a plurality of sides 412 (identified individually as 412*a-d*) and a bottom surface 413. The illustrated housing 410, however, does not include a lid or a compartment at the top, but rather a top surface 414 extending between the side surfaces 412. The illustrated top surface 414 has two support structures 440 proximate to the third and fourth sides 412*c-d*, respectively. The support structures 440 can include a receptacle 442 sized to receive a portion of a firearm support. Moreover, in the illustrated embodiment, the first side 412*a* and the top surface 414 are comprised of a generally non-flexible (i.e., rigid) material, and the second, third, and fourth sides 412*b-d* and the bottom surface 413 are composed of a generally flexible material. The flexible sides 412*b-d* and bottom surface 413 may allow the volume of the container 400 to be reduced for shipping or other transport and may be less likely to be damaged during transit. In other embodiments, however, the sides and the top or bottom surfaces can be composed of different materials. In either case, the container 400 may further include a plurality of storage devices 415 (shown in dashed lines) positioned at corresponding apertures in the first side 412*a*. In additional embodiments, the container 400 may not include storage devices 415 or may have other configurations.

FIGS. 5-9 are schematic isometric views of containers in accordance with other embodiments of the disclosure. The containers illustrated in FIGS. 5-9 are generally similar to the container 100 described above with reference to FIG. 1 and other embodiments described above. For example, the containers illustrated in FIGS. 5-9 may include flexible or non-flexible sides, as well as one or more firearm supports in the embodiments described below.

Figure 5:
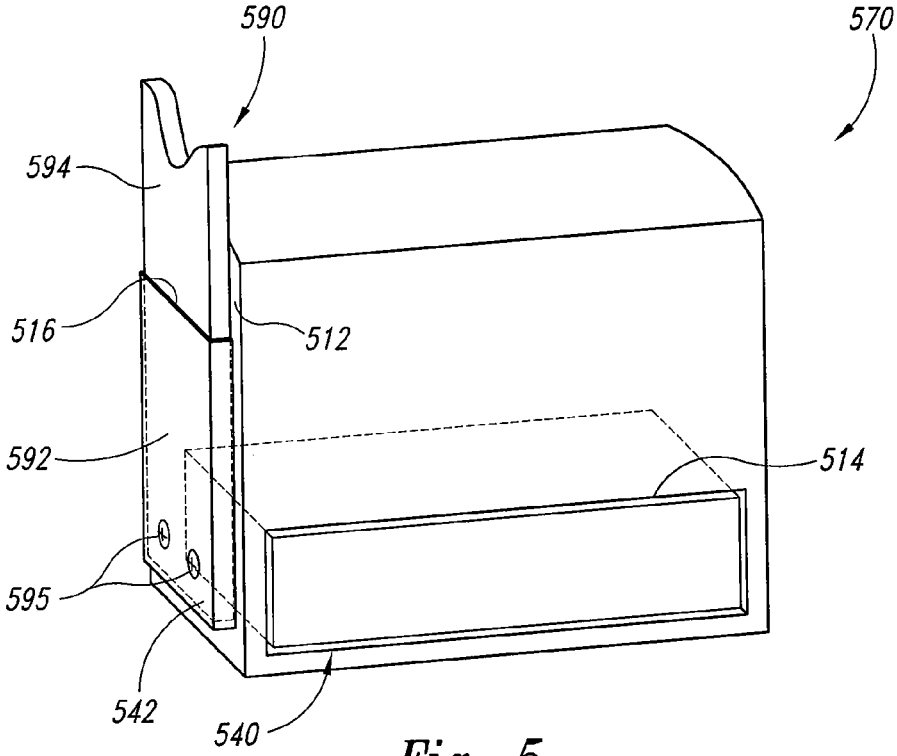
FIG. 5 is a schematic isometric view of a container for carrying firearm accessories and supporting a firearm in accordance with another embodiment of the disclosure.

FIG. 5 is a schematic isometric view of a container 500 in accordance with another embodiment of the disclosure. The illustrated container 500 includes firearm supports 590 that are removably fastened to a support structure 540 that supports and/or holds storage devices (not shown) in a front aperture 514 of the container 500. Specifically, the firearm supports 590 have a first portion 592 and a second portion 594 generally configured for supporting a firearm. The first portion 592 of the support 590 is positioned in a side portion 516 of the container 500 and mates to a sidewall 542 of the support structure 542. The second portion 592 is removably attached to the support structure 540 to provide a stable support for the firearm. For example, the second portion 592 may be bolted or screwed to the support structure 542, or removably fastened in other methods that are known in the art. The configuration as shown in FIG. 5 may include firearm supports 590 removably attached to the support structure 540 or other support structures of the container 500.

Figure 6:
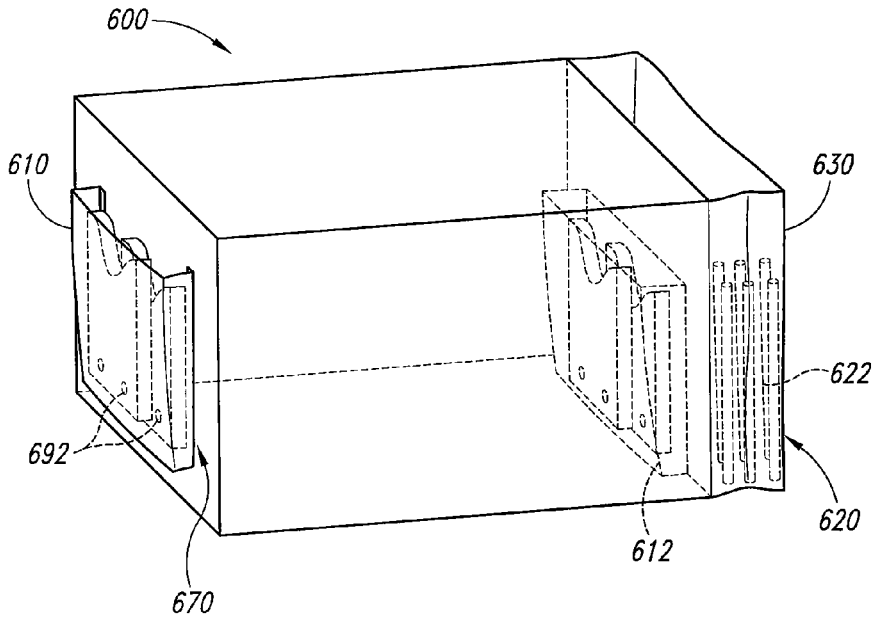
FIG. 6 is a schematic isometric view of a container for carrying firearm accessories and supporting a firearm in accordance with another embodiment of the disclosure.

FIG. 6 is a schematic isometric view of a container 600 in accordance with another embodiment of the disclosure. The illustrated container 600 includes a plurality of sleeves or compartments 610 and 612. The compartment 610 is configured to store firearm supports 690 when the supports 690 are not in use. The compartment 610 is positioned externally to the container 600, however in certain embodiments the compartment may be positioned inside the container 600 as illustrated by the compartment 612. The container also includes a support structure compartment 630 configured to store a support structure 620 when the support structure 620 is not in use. Similar to the compartments 610 and 612, the support structure compartment 630 may be positioned externally or internally of the container 600. In certain embodiments, the support structure 620 includes a plurality of supports 622 that are configured to be assembled to support and/or hold the firearm supports 690. For example, the supports 622 may be assembled in different areas of the container 600 such that a geometry of the assembled supports 622 generally aligns with a geometry of the container. In some embodiments, the supports 692 include a plurality of apertures 692 configured to receive individual supports 622.

Figure 7:
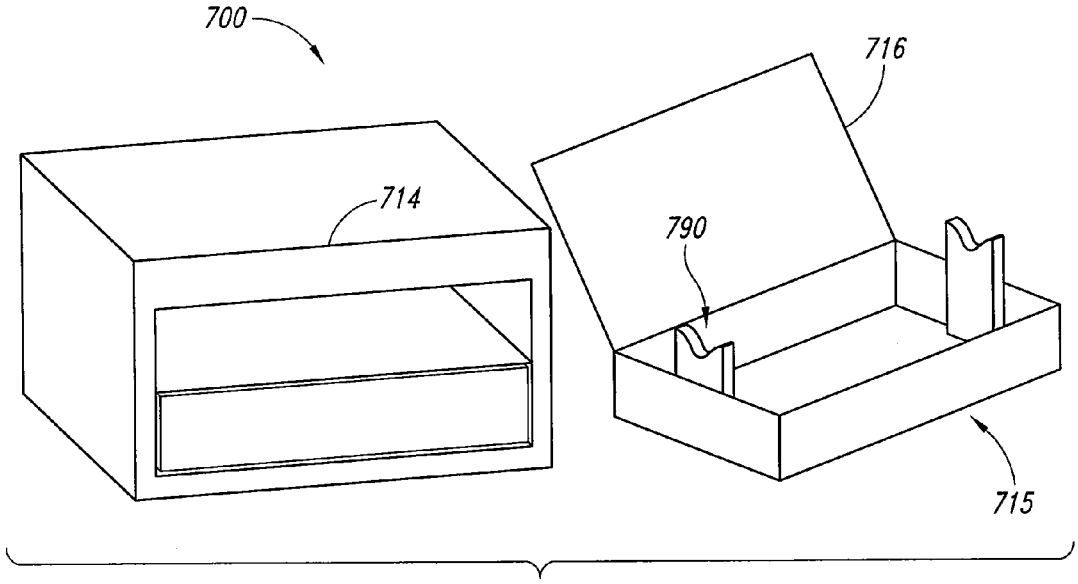
FIG. 7 is a schematic isometric view of a container for carrying firearm accessories and supporting a firearm in accordance with another embodiment of the disclosure.

FIG. 7 is a schematic isometric view of a container 700 in accordance with another embodiment of the disclosure. The illustrated container 700 includes an aperture 714 and a removable storage device 715 positioned at the aperture 714. The storage device 714 has similar characteristics to the storage devices described above, however the storage device 715 also includes one or more firearm supports 790. Accordingly, the storage device 715 can be removed from the container 700 to support a firearm with the supports 790 as a standalone device separate from the container 700. The container 700 can also contain firearm supports (not shown) in order to provide support for more than one firearm with the container 700 and the storage device 715. In alternative embodiments, the storage device 715 includes a cover 716 that encloses the storage device 715 when the storage device 715 is positioned in the aperture 714 of the container 700.

Figure 8:
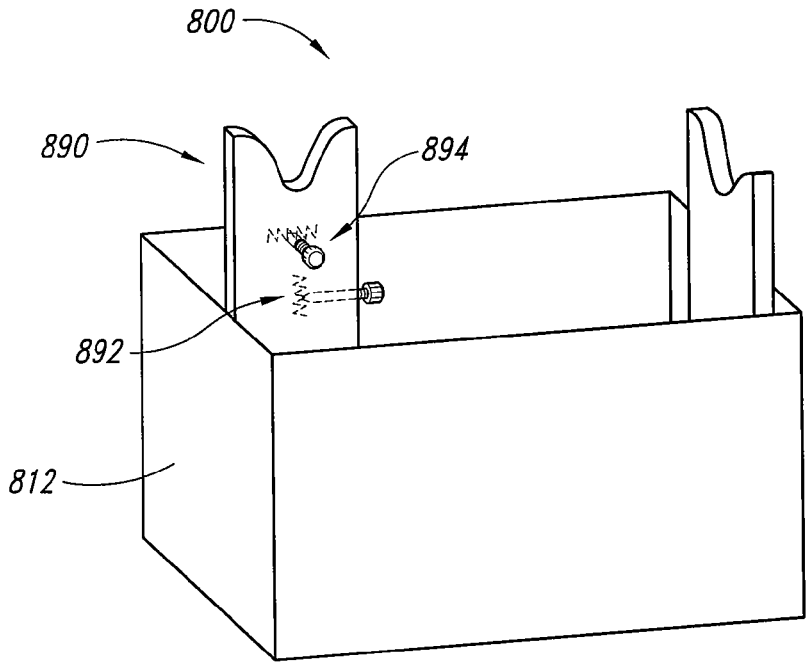
FIG. 8 is a schematic isometric view of a container for carrying firearm accessories and supporting a firearm in accordance with another embodiment of the disclosure.

FIG. 8 is a schematic isometric view of a container 800 in accordance with another embodiment of the disclosure. The illustrated container 800 includes firearm supports 890 that are adjustable both in the vertical and horizontal directions. For example, the support 890 can include a threaded insert 892 for adjusting the vertical position of the support 890, and threaded insert 894 for adjusting the horizontal position of the support 890. In other embodiments, the attachment of the support 890 to a side portion 812 of the container 800 can be configured to adjust or fine-tune the vertical and horizontal support positions 890. One skilled in the art will appreciate that other adjusting means conventional in the art may be used to adjust the position of the supports 890.

Figure 9:
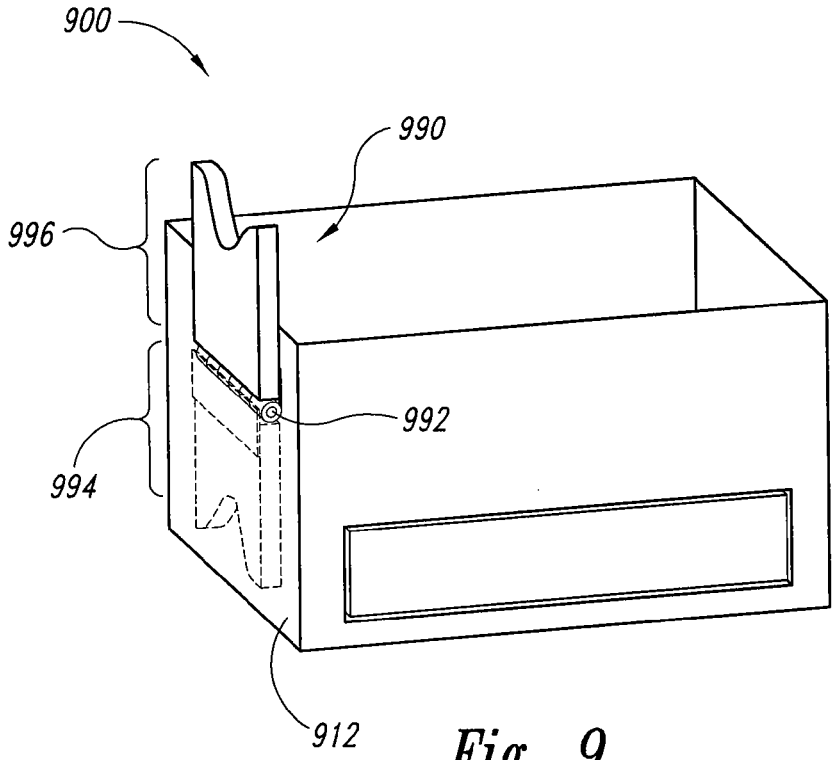
FIG. 9 is a schematic isometric view of a container for carrying firearm accessories and supporting a firearm in accordance with another embodiment of the disclosure.

FIG. 9 is a schematic isometric view of a container 900 in accordance with another embodiment of the disclosure. The illustrated container 900 includes firearm supports 990 that are configured to pivot between a stored position 994 (shown in broken lines) and a deployed position 996. Specifically, the supports 990 are attached to a side portion 912 of the container 900 with a hinge 992 such that the support 990 can pivot between the stored and deployed positions 994 and 996. The support 990 can be locked in the deployed position 996 and configured to support a firearm as described above.

One skilled in the art will appreciate that different manufacturing processes may provide variations of aspects of the embodiments described above. For example, side portions of the container may have varying thicknesses from one side to another, or the side portions may not be parallel. In addition, non-metallic or moldable material may be used for many of the components described above. For example, a translucent material may be molded to form the storage devices to allow a user to see the internal contents of the storage device. Moreover, the container or other components of the container may be molded and thereby constructed with four seamless side portions.

From the foregoing, it will be appreciated that specific embodiments of the invention have been described herein for purposes of illustration, but that various modifications may be made without deviating from the invention. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A container for carrying firearm accessories, the container comprising:

a housing having an exterior side surface;

an aperture in the exterior side surface;

a storage device at the aperture, the storage device having a compartment and being movable between a stowed position in which the compartment is positioned within the housing and a second position in which the compartment is at least partially external to the housing; and one or more support structures at the housing configured to interface with one or more removable firearm supports for carrying a firearm.

2. The container of claim 1 wherein:

the support structure comprises a first support structure for supporting a first removable firearm support;

the container further comprises a second support structure at the housing configured to support a second removable firearm support;

the first support structure comprises a receptacle with an opening sized to receive a portion of the first removable firearm support;

the storage device comprises a tray having a plurality of compartments; and the storage device is slidable between the stowed and second positions.

3. The container of claim 1 wherein the storage device further comprises a handle and a cover, wherein the cover is removably attached to the storage device, and wherein the storage device is removable from the container.

4. The container of claim 1 wherein the aperture generally bisects the exterior side surface, and wherein the storage device slides generally perpendicular to the exterior side surface between the stowed position and the second position.

5. The container of claim 1 wherein the support structure comprises a receptacle with an opening sized to receive a portion of the removable firearm support.

6. The container of claim 1 wherein the support structure comprises a first support structure for supporting a first removable firearm support, and wherein the container further comprises a second support structure at the housing and configured to support a second removable firearm support.

7. The container of claim 1 wherein the compartment comprises a first compartment, and wherein the housing further comprises a second compartment sized to receive the firearm support such that the container can carry the firearm support within the housing when the firearm support is removed from the support structure.

8. The container of claim 1 wherein the support structure is removable from the housing.

9. The container of claim 1 wherein:

the housing further comprises a shelf; and the support structure comprises a generally planar member removably positioned on the shelf.

10. The container of claim 1 wherein the storage device comprises a tray having a plurality of compartments.

11. The container of claim 1 wherein the storage device is slidable between the stowed and second positions.

12. The container of claim 1 wherein:

the storage device comprises a first storage device having a first compartment; and the container further comprises a second storage device at the aperture, the second storage device having a second compartment and being movable between a stowed position in which the second compartment is positioned within the housing and a second position in which the second compartment is at least partially external to the housing.

13. The container of claim 1 wherein the aperture comprises a first aperture in the exterior side surface, wherein the storage device comprises a first storage device having a first compartment, and wherein the container further comprises:

a second aperture in the exterior side surface; and a second storage device at the second aperture, the second storage device having a second compartment and being movable between a stowed position in which the second compartment is positioned within the housing and a second position in which the second compartment is at least partially external to the housing.

14. The container of claim 1 wherein:

the housing further comprises a plurality of sides and an opening at least partially defined by one or more of the sides;

the support structure is positioned at the opening such that the removable firearm support projects through the opening when the support structure interfaces with the firearm support; and the container further comprises a lid removably coupled to the housing at the opening.

15. The container of claim 1 wherein the housing comprises a flexible material.

16. The container of claim 1, further comprising the firearm support removably coupled to the support structure.

17. The container of claim 1 wherein the firearm support is removably attached to the support structure.

18. The container of claim 1 wherein the firearm support is attached to the support structure with a hinge mechanism, wherein the firearm support pivots between a stored position in which the firearm support is positioned within the container and a deployed position in which the firearm support is positioned to at least carry a firearm.

19. The container of claim 1 wherein the storage device is removable from the container, and the storage device further comprises one or more storage device firearm supports for carrying a firearm.

20. The container of claim 1 wherein the firearm support structure is configured to be adjustable in horizontal and vertical directions after interfacing with the support structure.

21. A receptacle for supporting a firearm, the receptacle comprising:

an enclosure having a plurality of sides and an opening defined by at least one of the sides;

a lid operably coupled to the enclosure and positionable at the opening;

an aperture in one of the sides;

a storage device externally accessible via the aperture, the storage device having a plurality of compartments sized to receive firearm accessories; and a support structure configured to support one or more removable firearm supports for carrying the firearm, the support structure being positioned such that the firearm support projects through the opening when the support structure carries the firearm support.

22. The receptacle of claim 21 wherein the aperture comprises a first aperture in a first side of the enclosure, and wherein the receptacle further comprises:

a second aperture in the first side of the enclosure; and a storage device accessible via the second aperture.

23. The receptacle of claim 21 wherein the storage device is slidable between a stowed position in which the storage device is positioned within the enclosure and a second position in which the storage device is at least partially external to the enclosure.

24. The receptacle of claim 21 wherein the storage device comprises a handle and a cover, and wherein the storage device is removable from the receptacle.

25. The receptacle of claim 21, further comprising a cover attached to the enclosure and movable between a closed position in which the cover is positioned at the aperture and an open position in which the cover is spaced apart from the aperture.

26. The receptacle of claim 21 wherein:

the support structure comprises a first receptacle with an opening sized to receive a portion of a first removable firearm support; and the receptacle further comprises a second receptacle at the enclosure with an opening sized to receive a portion of a second removable firearm support.

27. A container for carrying firearm accessories, the container comprising:

a housing having a plurality of sides, at least one of the sides including a flexible material;

a plurality of compartments within the housing, the compartments being sized to receive firearm accessories; and one or more support structures at the housing for interfacing with one or more removable firearm supports, the support structure positioned such that the firearm support projects from the housing when the firearm support interfaces with the support structure.

28. The firearm support of claim 27 wherein the support structure is positioned in a first compartment, and the container further comprises a frame removably received in a second compartment in the housing, the frame including one or more openings configured to receive a storage device.

29. The container of claim 27, wherein the one or more removable firearm supports are configured to support carry a firearm in a substantially horizontal position.

30. The container of claim 27, further comprising a frame removably received in the housing, the frame including a plurality of chambers sized to receive a storage device.

31. The container of claim 27, further comprising a frame removably received in the housing, the frame including a plurality of sub-frames sized to receive a storage device.

32. The container of claim 27, further comprising one or more storage devices disposed within corresponding compartments within the housing.

33. The container of claim 27 wherein the housing comprises an aperture, and wherein the container further comprises a storage device accessible externally via the aperture, the storage device including at least one of the compartments.

34. The container of claim 27 wherein the housing comprises a generally non-flexible side and a generally flexible side.

35. The container of claim 27 wherein the support structure comprises a first support structure for supporting a first removable firearm support, and wherein the container further comprises a second support structure at the housing for supporting a second removable firearm support.

36. The container of claim 27 wherein the support structure comprises a receptacle sized to receive a portion of the firearm support.

37. The container of claim 27 wherein the support structure is comprised of a plurality of interconnecting supports, the container further comprising:

a firearm support compartment configured for storing one or more firearm supports; and a support structure compartment configured for storing the plurality of supports.

38. A receptacle for supporting a firearm, the receptacle comprising:

an enclosure having a plurality of sides and an aperture, at least one of the sides including a flexible portion;

a storage device within the enclosure and positioned at the aperture, the storage device having a compartment sized to receive a firearm accessory;

a support structure at the enclosure; and one or more firearm supports removably coupled to the support structure, the firearm support being configured to carry a section of the firearm.

39. The receptacle of claim 38, further comprising a frame removably received in the enclosure, the frame including the support structure and a chamber sized to receive the storage device.

40. The receptacle of claim 38 wherein at least one of the sides of the enclosure is generally non-flexible, and wherein the support structure is positioned at the generally non-flexible side.

41. A receptacle for supporting a firearm, the receptacle comprising:

a housing having a side surface;

an aperture in the side surface;

means for storing firearm accessories in the housing such that the firearm accessories can be removed from the housing via the aperture; and means for supporting one or more removable firearm supports configured to carry a firearm.

42. The receptacle of claim 41 wherein the means for storing firearm accessories comprise a tray coupled to the housing and movable between a stowed position in which the tray is positioned within the housing and a second position in which the tray is at least partially external to the housing.

43. The receptacle of claim 41 wherein the means for storing firearm accessories comprise a storage device accessible externally via the aperture.

44. The receptacle of claim 41 wherein:

the housing further includes an opening; and the means for supporting the firearm support are positioned at the opening.

45. The receptacle of claim 41 wherein the means for supporting the removable firearm support comprise a receptacle sized to receive a portion of the firearm support.

46. The receptacle of claim 41 wherein:

the housing further includes a support shelf; and the means for supporting the removable firearm support comprise a removable support structure sized to rest on the support shelf.

47. A method of supporting a firearm for cleaning and/or maintenance, the method comprising:

removably attaching first and second firearm supports to corresponding support structures at an opening of a container;

placing the firearm on the first and second firearm supports; and moving a storage device at least partially through an aperture in a side of the container.

48. The method of claim 47 wherein removably attaching the first and second firearm supports to corresponding support structures comprises positioning a portion of the individual first and second firearm supports in corresponding receptacles of the support structures.

49. The method of claim 47 wherein moving the storage device comprises sliding a tray at least partially through the aperture in the side of the container.

50. The method of claim 47, further comprising retrieving the first and second firearm supports from a compartment in the container before removably attaching the first and second firearm supports.

51. The method of claim 47, further comprising:

removing the firearm from the first and second firearm supports;

detaching the first and second firearm supports from the support structures; and storing the first and second firearm supports in the container.

52. The method of claim 47, further comprising storing a plurality of firearm accessories in the storage device.

* * * * *